US005461751A

United States Patent [19]

Sepke

[11] Patent Number: 5,461,751

[45] Date of Patent: Oct. 31, 1995

[54] CEDAR AIR FRESHENER FOR VACUUM CLEANER BAGS

[75] Inventor: Arnold L. Sepke, Hudson, Ill.

[73] Assignee: White Consolidated Industries, Inc., Cleveland, Ohio

[21] Appl. No.: 190,853

[22] Filed: Feb. 3, 1994

[51] Int. Cl.[6] ..... B01D 46/02

[52] U.S. Cl. ..... 15/246.3; 15/339

[58] Field of Search ..... 15/246.3, 339

[56] References Cited

U.S. PATENT DOCUMENTS

| | | | |
|---|---|---|---|
| 1,863,883 | 6/1932 | Schneider | 15/246.3 X |
| 1,867,640 | 7/1932 | Widders et al. | 15/246.3 X |
| 2,450,368 | 9/1948 | Baxter | 15/246.3 X |
| 2,587,991 | 3/1952 | Gerber | 15/246.3 X |
| 4,554,698 | 11/1985 | Rennecker et al. . | |
| 4,735,626 | 4/1988 | Smith et al. . | |
| 4,821,365 | 4/1989 | Charters | 15/339 |
| 5,029,359 | 7/1991 | Ortega . | |
| 5,040,264 | 8/1991 | Bryant . | |
| 5,342,420 | 8/1994 | Bosses | 15/246.3 X |

OTHER PUBLICATIONS

*Home Furnishings Daily,* "Cedar Fresh Wins EPA OK", Dec. 1991.

*Primary Examiner*—Chris K. Moore

*Attorney, Agent, or Firm*—Pearne, Gordon, McCoy & Granger

[57] ABSTRACT

Cedar chips are used as an air freshener and pesticide in a vacuum cleaner bag. The chips can be loose or contained in a porous "tea bag." Cedar oil may be used to augment the effect of the chips. The chips are placed in the receptacle or vacuumed from the floor.

6 Claims, 1 Drawing Sheet

CEDAR AIR FRESHENER FOR VACUUM CLEANER BAGS

BACKGROUND OF THE INVENTION

1. Field of the Invention

This invention relates generally to the field of vacuum cleaners and specifically to a cedar air freshener therefor.

2. Description of the Related Art

Vacuum cleaner receptacles or bags typically hold more dirt than is vacuumed up at one time. Thus, the dirt and other contaminants sit in the receptacle while the vacuum cleaner is stored in a closet or other space. While stored, air in the receptacle is or becomes malodorous. Of necessity, the receptacle is porous, and the malodorous air contaminates the storage space. In addition, dust mites and other pests emanate from or are attracted by the dirt in the receptacle.

Accordingly, it is desirable to provide an air freshener and a pesticide for the receptacle. U.S. Pat. Nos. 4,554,698 to Rennecker et al., 4,735,626 to Smith et al., 5,029,359 to Ortega, and 5,040,264 to Bryant show examples of air fresheners for vacuum cleaner receptacles.

Cedar has recently gained acceptance as a natural air freshener and moth repellant. For example, Cedar Fresh Products of Norristown, Penna. sells cedar sachets for clothing. The sachets are porous receptacles containing cedar, as described in an article from *Home Furnishings Daily* (December 1991) entitled "Cedar Fresh Wins EPA Ok."

It would be desirable to utilize the characteristics of cedar as an air freshener and pesticide in a vacuum cleaner receptacle.

SUMMARY OF THE INVENTION

The present invention provides a vacuum cleaner having an intake nozzle, a receptacle or bag, and a blower or other dirt lifting means for creating a flow from the nozzle to the receptacle so as to carry dirt from the nozzle into the receptacle. Cedar chips are contained in the receptacle.

The chips may be contained in the receptacle in a porous sack, for example. Cedar oil may be applied to the chips.

The cedar chips are easily and conveniently placed in the receptacle and act as an air freshener and a pesticide. Unpleasant odors in the receptacle are neutralized or masked. Moths, dust mites, and other pests are repelled or killed.

The cedar chips can be vacuumed from the floor into the receptacle to leave cedar vapor in the air path. The receptacle need not be removed and the chips need not be inserted directly into the receptacle.

DESCRIPTION OF THE PREFERRED EMBODIMENTS

Figure 1:
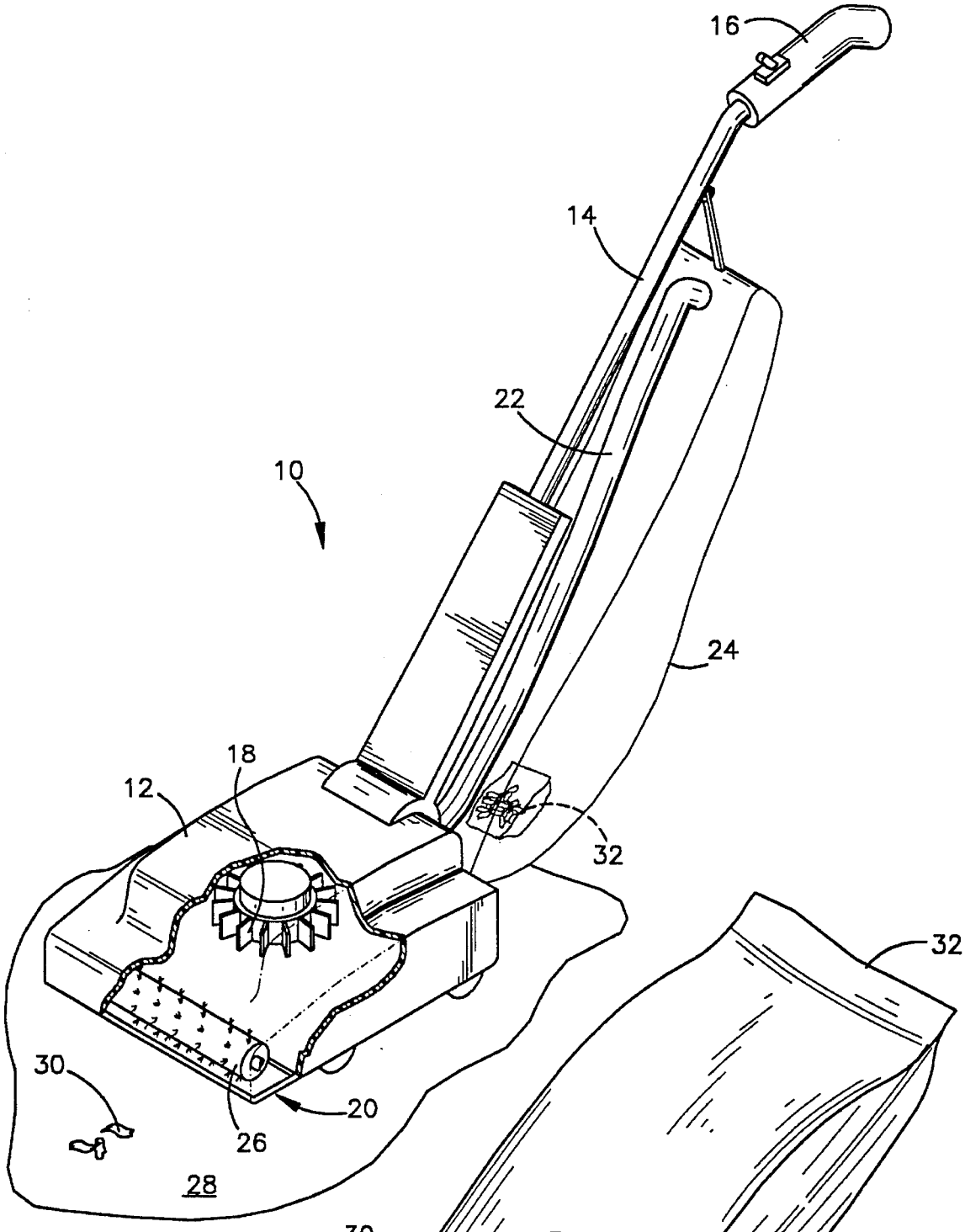
FIG. 1 shows a partially cut away perspective view of a vacuum cleaner according to the invention.

Referring to FIG. 1, a vacuum cleaner 10 has a body 12 and a pivoting arm 14 with a handle 16. The vacuum cleaner shown is an upright type vacuum, but the present invention is applicable to any type of vacuum having a receptacle or other device for collecting or containing dirt or other waste. A blower 18, fan, impeller or other vacuum creating device of a type known in the art is disposed within the body. The blower 18 creates an air flow from a downwardly opening intake nozzle 20, through the body 12 and a conduit 22, to a receptacle 24, bag, or other type of receptacle. The receptacle may be rigid or flexible, as is known in the art. A rotating brush 26 or agitator is disposed in the nozzle 20 to loosen dirt on a floor 28 on which the vacuum is working. The blower, brush, or agitator, alone or in combination, defines a dirt lifting means which propels the dirt from the floor into the bag or receptacle.

The receptacle 24 is made of a porous material of a type known in the art so that air from the blower 18 flows through the receptacle while dirt entrained in the air flow is trapped in the receptacle. The receptacle is removable so that when the receptacle is full, it can be emptied or replaced.

In use, cedar chips 30 are placed on the floor 28, preferably when a new receptacle 24 is installed on the vacuum cleaner 10. The cedar chips 30 are made of aromatic red cedar, similar to the type used for rodent bedding. The surface area of the chips should be maximized to provide the best results for the volume of chips used. The effect of the chips can be enhanced by adding extract of cedar oil to the chips. The vacuum cleaner is run over the chips 30 to suck the chips into the receptacle 24. In the receptacle, the chips serve as an air freshener and pesticide.

Figure 2:
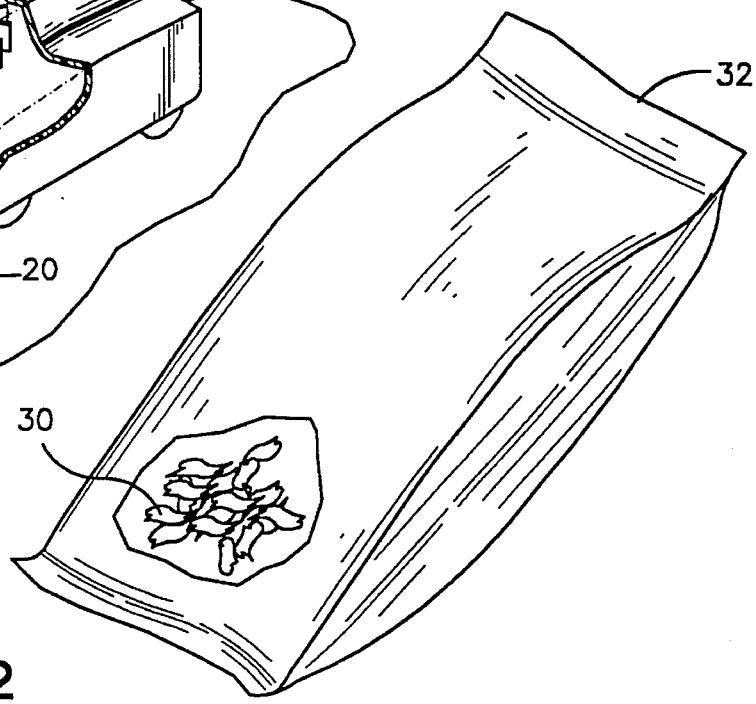
FIG. 2 shows a partially cut away perspective view of a sack containing cedar chips.

Alternatively, with reference to FIG. 2, the cedar chips are contained in a sack 32 similar to a tea bag. The sack is made from paper or another porous material suitable to hold the cedar chips while being permeable by air carrying vaporized cedar oil from the chips. The air passes through the sack 32 to freshen the air in the receptacle 24 and act as a pesticide. The size of the sack depends on the size of the receptacle 24. About one inch square has been found suitable for most applications.

Prior to use, the cedar chips should be stored in an air tight container to preserve the effect of the oil. Separate cedar chips 30 or the sack 32 filled with chips can be placed directly in the receptacle when the receptacle 24 is removed or vacuumed into the receptacle 24 after the receptacle is installed.

The invention requires no additional parts or modifications of the vacuum cleaner and is useful in virtually any type of vacuum cleaner.

The present disclosure describes several embodiments of the invention, however, the invention is not limited to these embodiments. Other variations are contemplated to be within the spirit and scope of the invention and appended claims.

What is claimed is:

1. A vacuum cleaner, comprising:

an intake nozzle;

a receptacle;

a dirt lifting means for creating a flow from the nozzle to the receptacle so as to carry dirt from the nozzle into the receptacle; and cedar chips augmented with cedar oil and contained in the receptacle.

2. A vacuum cleaner according to claim 1, further comprising a porous sack disposed in the receptacle and containing the cedar chips.

3. A vacuum cleaner according to claim 1, wherein the dirt lifting means comprises a blower.

4. A vacuum cleaner, comprising:

an intake nozzle;

a receptacle;

a dirt lifting means for creating a flow from the nozzle to the receptacle so as to carry dirt from the nozzle into the receptacle;

cedar chips; and a closed porous sack containing the cedar chips and contained in the receptacle.

5. A vacuum cleaner according to claim 4, wherein the chips are augmented with cedar oil.

6. A vacuum cleaner according to claim 3, wherein the dirt lifting means comprises a blower.

* * * * *